US008070549B2

(12) United States Patent
King

(10) Patent No.: US 8,070,549 B2
(45) Date of Patent: Dec. 6, 2011

(54) BABY TOY WITH BABY CARE ITEMS

(76) Inventor: Molly King, Wildwood, MO (US)

( * ) Notice: Subject to any disclaimer, the term of this patent is extended or adjusted under 35 U.S.C. 154(b) by 157 days.

(21) Appl. No.: 12/454,499

(22) Filed: May 19, 2009

(65) Prior Publication Data

US 2009/0305601 A1 Dec. 10, 2009

Related U.S. Application Data

(60) Provisional application No. 61/131,598, filed on Jun. 10, 2008.

(51) Int. Cl.
*A63H 33/00* (2006.01)

(52) U.S. Cl. ..... 446/71; 446/75; 446/227

(58) Field of Classification Search ..... 446/71–77, 446/81, 227, 369, 397, 418, 419, 421, 422, 446/491
See application file for complete search history.

(56) References Cited

U.S. PATENT DOCUMENTS

| | | | | |
|---|---|---|---|---|
| 4,574,822 | A * | 3/1986 | Helinsky | 132/286 |
| 4,746,008 | A * | 5/1988 | Heverly et al. | 206/1.5 |
| 5,267,668 | A * | 12/1993 | Jones | 220/326 |
| 5,326,300 | A * | 7/1994 | Sonders | 446/74 |
| 5,593,336 | A * | 1/1997 | Thomas | 446/81 |
| 6,238,263 | B1 * | 5/2001 | Bennett | 446/330 |
| 6,523,690 | B1 * | 2/2003 | Buck et al. | 206/494 |
| D536,041 | S * | 1/2007 | Luconi | D21/408 |
| 2004/0116046 | A1 * | 6/2004 | Miyawaki et al. | 446/491 |
| 2006/0199157 | A1 * | 9/2006 | Stamm et al. | 434/236 |
| 2007/0131694 | A1 * | 6/2007 | Moran et al. | 220/376 |
| 2007/0138196 | A1 * | 6/2007 | Nguyen | 221/33 |
| 2007/0199841 | A1 * | 8/2007 | Mesalic | 206/233 |

FOREIGN PATENT DOCUMENTS

JP 2007076736 A * 3/2007

* cited by examiner

*Primary Examiner* — Gene Kim
*Assistant Examiner* — Alyssa Hylinski
(74) *Attorney, Agent, or Firm* — Jacobson & Johnson LLC

(57) ABSTRACT

A baby distraction item and more specifically a baby toy for storing baby care items such as baby clean-up items with the baby toy temporarily distracting a baby with the baby top comprising either a cover or a base with a chamber for holding baby care item so that when a caretaker cleans up a baby, the baby may grasp the handle and play with the base or cover as a toy to distract the baby while a diaper is changed.

4 Claims, 3 Drawing Sheets

BABY TOY WITH BABY CARE ITEMS

CROSS REFERENCE TO RELATED APPLICATIONS

This application claims priority from provisional patent application Ser. No. 61/131,598 filed Jun. 10, 2008 titled COVER WITH TOY.

FIELD OF THE INVENTION

This invention relates generally to a baby distraction item and, more particularly, to a baby toy and/or a baby toy comprising a container for baby care items with the baby toy suitable for attracting and maintaining the attention of a baby while a diaper is being changed.

STATEMENT REGARDING FEDERALLY SPONSORED RESEARCH OR DEVELOPMENT

None

REFERENCE TO A MICROFICHE APPENDIX

None

BACKGROUND OF THE INVENTION

Young children have difficulty in being still and quiet during social interactions or engagements during which the child is expected to be still and quiet (i.e., riding in a car, bus train or airplane, in a store during shopping trips, at a place of worship, at the doctor's office, at a restaurant, during clean up, etc.). Parents often resort to distracting a child wherein the child's attention is redirected to a toy with which he or she can play with. The typical result of using a distraction item, such as a toy, is that the child becomes content, still and quiet. One of the more challenging parental tasks is simultaneously changing a baby's diaper and distracting a baby while the parent and the baby are away from home and no toys are available to distract the baby.

Examples of toy items parents used in attracting and maintaining a baby's attention are toys with distinct patterns, colors, shapes or textures. For example, newborn babies respond well to bold, contrasting colors and graphics. The high-contrast colors of black, white and red can captivate and hold a baby's attention and can encourage visual development as well as physical activity such as wiggling, kicking, and arm waving. In addition to maintaining a babies attention babies learn about their environment through touching and handling different shapes and textures. Another example of a baby toy that distracts a baby which also helps a baby learn is a mirror which teaches cause and effect. Consequently, toys which distract may also be learning tools for the baby.

When a baby toy for distracting a baby is not readily available but would be helpful if it were available is when a parent is away from home and needs to change a diaper or clean a baby's face or hands. Unfortunately, the need to change a diaper or clean a baby on-the-go can take place in inopportune places where a baby toy to distract the baby may not be available. Even though a parent usually carries a diaper changing kit, the kit is often used to hold only essential items such as diapers and a container of towelettes for cleaning a baby when a diaper is changed. Consequently, a parent may struggle to both change a diaper and distract the baby, particularly if the parent is in a public place and feels a crying baby creates a disturbance to those present.

SUMMARY OF THE INVENTION

The invention is a baby toy integrated with a container or the cover where the container or cover not only holds baby care items but also provides a toy for distracting the baby. In one example the container comprises a carrier for holding cleaning items such as towelettes so that a parent who is on-the-go has both a source of readily available cleaning items but also a toy to temporarily distract the attention of a baby when the baby's diaper is being changed.

DESCRIPTION OF THE PREFERRED EMBODIMENT

Figure 1:
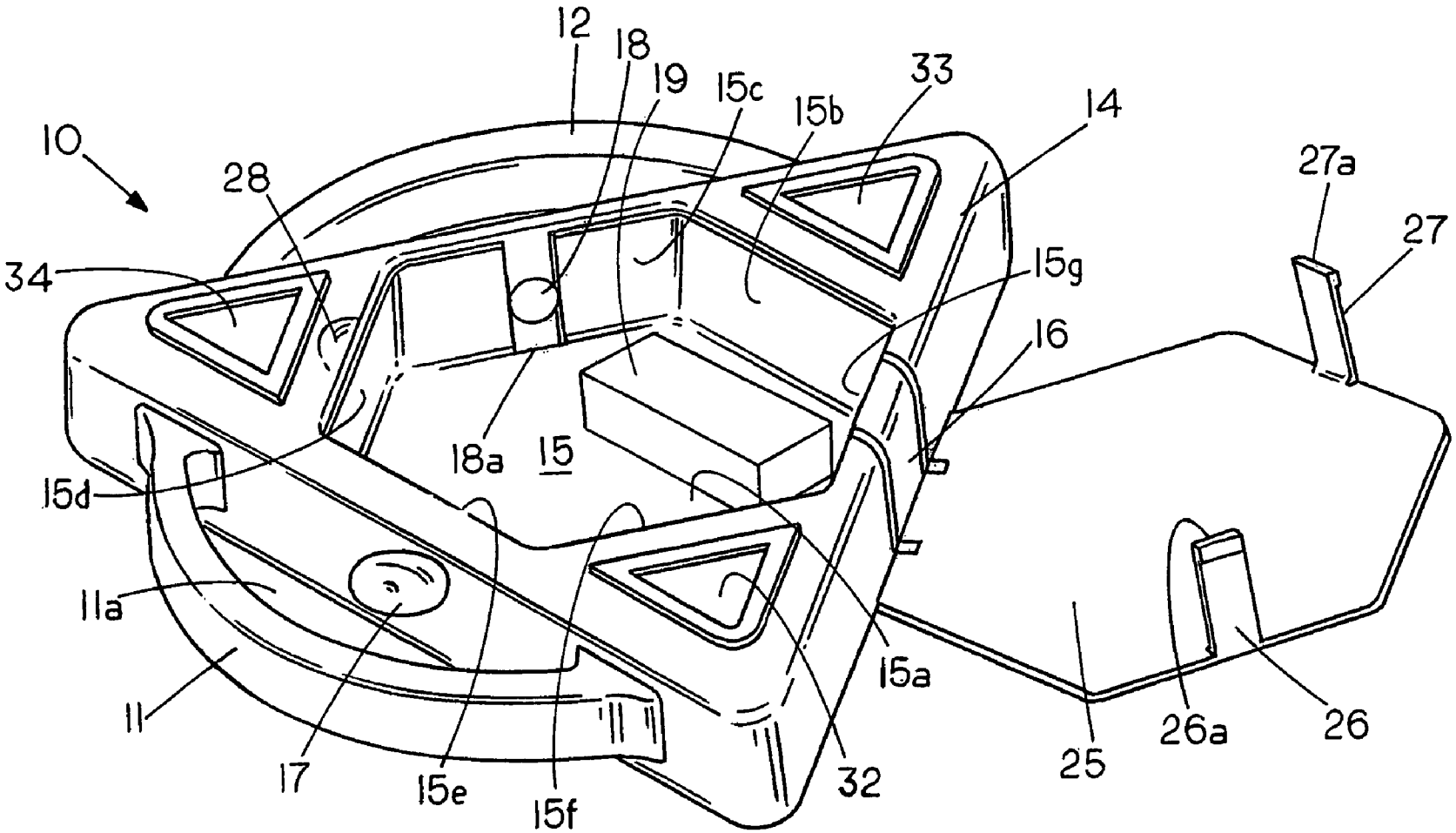
FIG. 1 is a perspective view of a baby toy in an open condition.

It is advantageous to temporarily attract and maintain a baby 's attention in order to make diapering or clean up a pleasant experience for the baby as well as less stressful for the parent. FIG. 1 illustrates an example of a baby distraction item, such as a baby toy, where the container and a baby distraction item are integrated so that a parent always has a readily available baby toy that can be used to both distract a baby as well as carry baby care items such as cleaning items. Baby toy 10 is shown in an open condition and comprises a container base 14 and a hinged cover 25 that extends over a chamber 15 for holding a baby care item 19 such as a baby clean-up cloth, for example a towelette or the like. In the example shown, base 14 has a triangular shape, however other shapes are within the scope of the invention. To distract a baby the base 14 may be decorated with a pattern, color, shape, texture or contain a reflector such as a mirror. The pattern or design on base 14 may be solid colors which the baby responds to such as be black, white and red.

Centrally located in base 14 is a chamber or compartment 15 for holding baby clean-up items such as a towelette 19, baby powder (not shown) or diaper cream (not shown). Bottom member 15*a* and sidewalls 15*b*, 15*c*, 15*d*, 15*e*, 15*f* and 15*g* cooperate to form a hexagonal shaped compartment for receiving and dispensing baby care items. While a hexagonal shaped compartment 15 is shown other shape compartments may be used without departing from the spirit and scope of the invention.

Baby toy 10 includes a cover 25 that pivots about hinge 16 with the cover extending over the open compartment 15 to maintain items in the compartment. Hinge 16 allows cover 25 to easily open and close while chamber 15 provides a storage compartment for clean-up items as well as to provide adult accessibility to the contents in chamber 15. Cover 25, when open, allows adult access to the items stored in chamber 15 and when closed provides a childproof container that keeps items securely stored in chamber 15. For example, one can store towelettes in chamber 15 as cover 25 keeps the towelette in a moist condition by protecting the towelettes from exposure to air, which causes them to dry out.

Baby toy 10 includes a set of curved handles 11 and 12 that extend outward from base 14. Handles 11 and 12 are sufficiently small such that a baby may easily grasp, manipulate and release the handles with his or her hands. While FIG. 1 shows baby toy 10 having two handles, fewer or more handles may be used to permit a baby to grasp the toy. For example, the invention may include one handle or the handle may be formed as an integral component of the baby toy since the purpose of a handle is provide a region that permits a baby to grasp and play with the baby toy 10 while the parent changes the baby's diaper.

FIG. 1 shows an opening 11*a* located between base 14 and handles 11 and an opening 12*a* located between base 14 and handle 12. The openings 11*a* and 12*a* are sufficiently large to prevent a baby from lodging his or her hands, feet or other body part in the opening and causing injury.

Extending perpendicularly outward from cover 25 are two elongated resilient latching members, 26 and 27 that are integral with cover 25. On the proximal end of each of the resilient members is a lip. That is, resilient member 26 includes a lip 26*a* and resilient member 27 includes a lip 27*a*. In a closed condition lip 27*a* engages with an edge 18*a* on sidewall 15*c* to latch cover 25 to base 14 and similarly lip 26 engages with a lip (not shown) on sidewall 15*e* to latch cover 25 to base 14 to form a child proof closed compartment for holding baby care items therein. A retractable button 17, which is axially slideable but retained within base 14, permits engagement with strip 26 and a further button 18 which is axially slideable but retained within base 14 permits engagement with strip 27 to permit opening the cover on the container.

Figure 2:
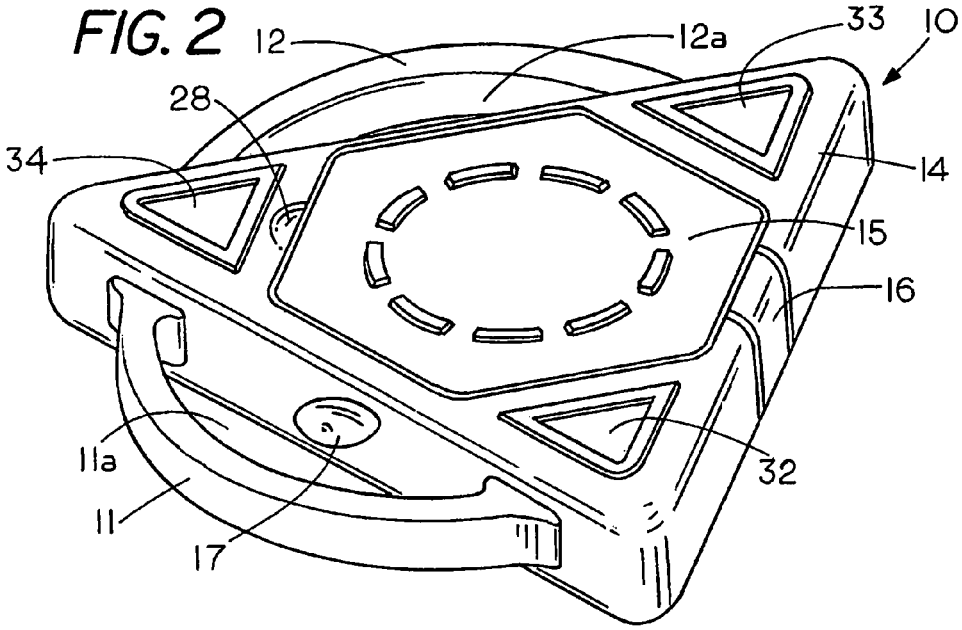
FIG. 2 is a perspective view of a baby toy of FIG. 1 in a closed condition.

FIG. 2 shows baby toy 10 in a closed condition to prevent a baby from opening cover 25 and pinching his or her fingers in cover 25 while holding or playing with the baby toy in his or her hands. Baby toy 10 includes a triangular shaped design 32 with a bright color therein or a mirror on one corner of base 14. Similarly, base 14 also includes a second triangular shaped design 33 with a bright color or a mirror and a third triangular shaped design 34 with a bright color or a mirror therein. The purpose of the design and color or a mirror is to provide an attraction for the baby. Although three identical shapes and colors or mirrors are shown various combinations of surface shapes colors or textures may be used to maintain a baby's interest.

To obtain access to compartment 15, a parent disengages lips 26*a* and 27*a* by simultaneously pushing inward on buttons 17 and 18 (FIG. 1) which disengages the lips 26*a* and 27*a* from the respective edges. The use of two buttons that are spaced apart and require simultaneously engagement makes the cover 25 baby proof since a baby cannot readily perform the function of simultaneously compressing two remotely positioned buttons. Once the parent disengages lips 26*a* and 27*a* the parent can insert a finger in a curved recess 28 in base 14 to enable the parent to pivot cover 25 about hinges 16 in order to obtain access to an item in the chamber.

When the clean-up items contained in the baby toy have been depleted, replacement items can be placed in the container/toy. Thus the baby toy is reusable.

Figure 3:
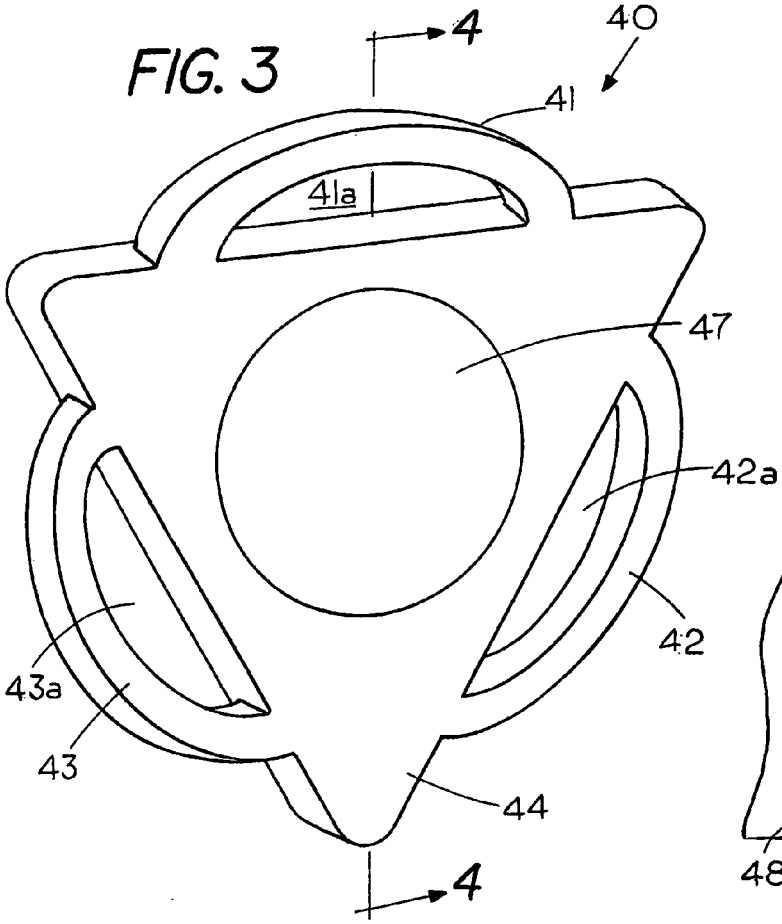
FIG. 3 is a perspective view of a baby toy comprising a cover.
Figure 4:
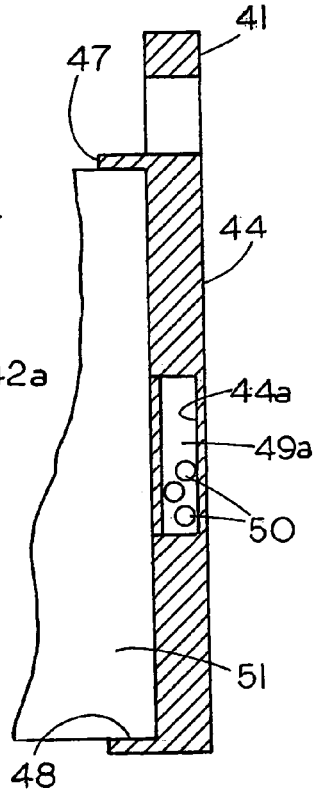
FIG. 4 is a cross-sectional view of the baby toy cover of FIG. 3.

Referring to the drawings, FIGS. 3 and 4 illustrate an example of a baby toy cover 20, which may be used with a container to temporarily distract a baby. The container, for example, is a readily available towelette container having a cover to maintain the moisture of the towelettes. The towelette container may be replaced or refilled once the towelettes have been depleted while the baby toy cover 20 is reusable and may be placed on the replacement or refilled towelette container.

FIG. 3 shows another example of a baby toy wherein the toy comprises a cover or lid 40 that can be fitted over an open top container. Cover 40 include a set of three handles 41, 42 and 43 with each of the handles extending outward and integral to cover 40 to enable a baby to grasp one or more handles. Curved handles 41, 42 and 43 extend outward. Handles 41, 42 and 43 are sufficiently small such that a baby could easily grasp, manipulate and release the handles with his or her hands. The space between cover 40 and handles 41, 42 and 43 are openings 41*a*, 42*a* and 43*a* are sufficiently large to prevent a baby from lodging his or her hands, feet or other body part in the openings and causing injury. In the examples shown the baby toy is made from a polymer plastic and any sharp edges have been removed so as avoid injury to the baby.

FIG. 4 shows a cross-sectional view of baby toy comprising a cover 20 that is frictional fitted over a top of a container 51 by an annular lip 47 that engages the outer cylindrical surface of container 51. Cover 44 is shown in section to reveal an internal compartment 44*a* formed by a chamber wall 44*a*. Located within compartment is a noisemaker 50, such as a plurality of hard beads or balls which can impact against the walls 44*a* when a baby shakes or moves the cover 44 to generate a noise. Alternatively, a squeaker or other noise-making device may be contained in compartment 44*a*. Regardless of which noisemaker is employed, compartment 44*a* is permanently sealed to prevent a baby from choking on small items in noisemaker 30.

Thus a noisemaker, such as a rattle, could be included in the baby toy to keep the attention of a baby. More specifically, a plurality of hard plastic beads or balls could be housed in either the handles or the cover so that the baby toy makes noise when a baby shakes or moves the baby toy.

FIG. 1 and FIG. 2 illustrate examples of how the baby toy can be integrated with a container to provide a distraction item that can be carried in the baby supplies and FIGS. 3 and 4 illustrate examples of how a removable cover can provide a baby toy for distracting and entertaining a baby as diaper is changed.

Figure 5:
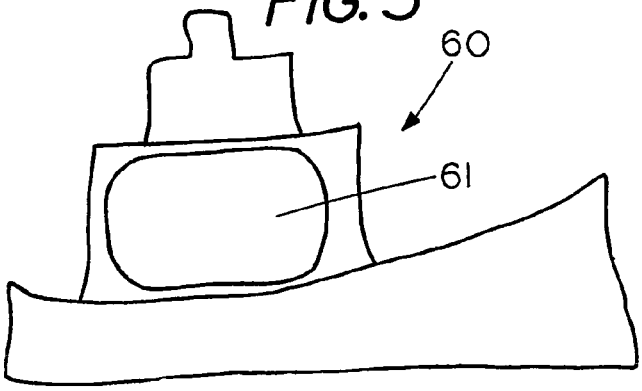
FIG. 5 is a perspective view of an alternate embodiment of a baby toy container and cover in the shape of a boat.

FIGS. 5-9 show examples of baby toys wherein a cover is either provide with a shape of an object or is part of an object while FIG. 5 shows a baby toy 60 in the shape of a boat with a cover 61 extending over a compartment (not shown) for holding baby care items.

Figure 6:
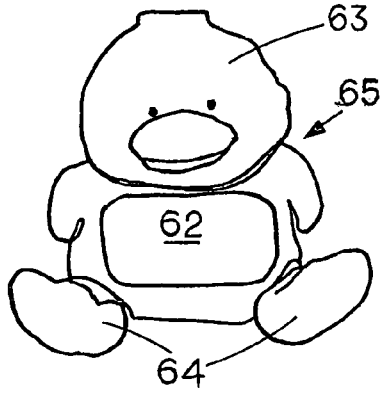
FIG. 6 is a front view of a baby toy container and cover in the shape of a duck.

Similarly, FIG. 6 shows a baby toy in the shape of a bird 65 with a compartment located blow a cover 62. In this example the baby handle comprises the animal appendages such as the head 63 or the feet 64. Baby toy 65 may be plush toy or a flat member in the shape of a bird head 63. The cover 62 which extends over a chamber (not shown) may contain baby care items such as a towelette package. Although a cover 62 is shown for removal of baby care items it is envisioned that the towelette or other baby care items may be dispensed from baby toy 65 through an opening in cover 62.

Figure 7:
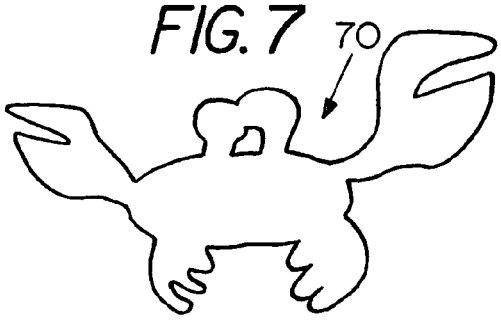
FIG. 7 is a front view of another example of a baby toy cover in the shape of a crab.
Figure 10:
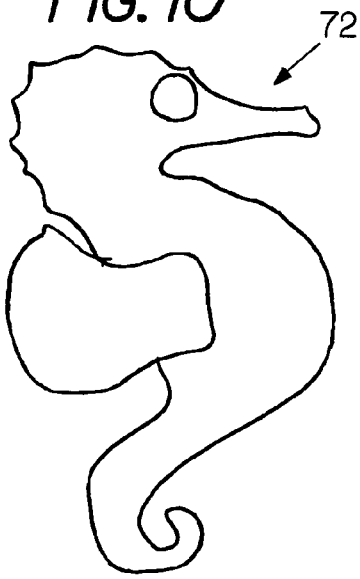
FIG. 10 is a front view of a baby toy cover in the shape of a seahorse.

FIG. 7 and FIG. 10 illustrate varies covers or containers in the shape of sea animals. FIG. 7 shows a cover in the shape of a crab 70 and FIG. 10 shows a cover in the shape of a sea horse 72. While a sea animal is shown as part of a cover it can be incorporated into the baby toy to have an integral compartment cover or both a cover and a container. In these examples of sea animals 70 and 72 a baby can use the appendages as a handle.

Figure 8:
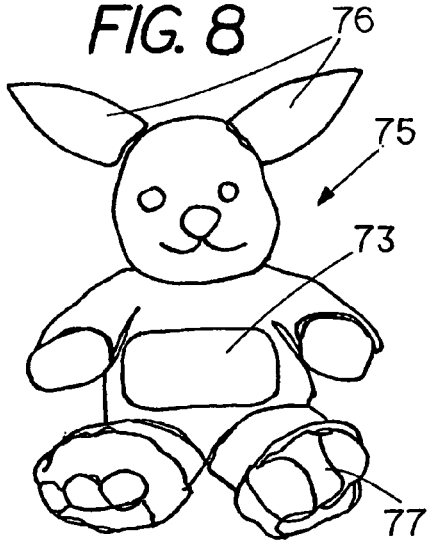
FIG. 8 is a front view of a baby toy container and cover in the shape of a rabbit.
Figure 9:
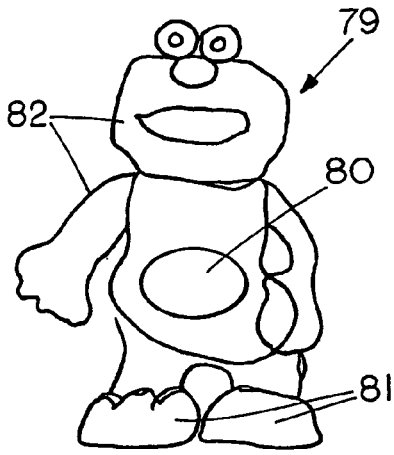
FIG. 9 is a front view of a baby toy container and cover in the shape of a cartoon character.

FIG. 8 shows a baby toy 75 in the shape of a rabbit with appendages including rabbit ears 76 and 77 which can be used as a baby handle. A cover 73 that can be opened or closed allows a person access to a compartment in the body of the baby toy. Similarly, FIG. 9 shows a baby toy 75 in the shape of a cartoon character with appendages including head and ears 82 and feet 81 which a baby can use as handle. A cover 80 that can be opened or closed allows a person access to a compartment in the body of the baby toy.

As illustrated by FIGS. 5-9 the baby toys can take a variety of shapes and the baby toys can be ether a cover or a container and either the cover or the container can be used to distract a baby as the diaper is being changed including but not limited to animals, fish, vehicles or other forms of transportation and popular characters. It is noted that components of the baby toys described herein are composed of a non-toxic material such as a polymer plastic and have smooth edges to protect a baby from injury.

In summary, when a parent changes a baby's diaper, the parent takes the diapering supplies, including moist towelettes, diaper and other diapering supplies such as ointment or powder. The parent then places the baby on the changing pad. The moist towelettes are removed from the baby toy or the baby toy cover is removed from the container. The baby toy or baby toy cover is then given to the baby to play with during diapering. The baby holds onto the handles with his or her hands and looks at and plays with the baby toy while the caregiver undresses the baby, cleans the baby's bottom, puts a clean diaper on him or her and redresses him or her.

I claim:

1. The method of changing a diaper on a baby comprising the steps of:

opening a cover on a compartment in a baby toy by simultaneously pressing a first axially retractable button located beneath a first handle and a second axially retractable button located beneath a second handle;

removing a baby care item from the baby toy;

latching the cover to the baby toy;

placing the baby toy in a hand of the baby;

allowing the baby to grasp either the first handle or the second handle or both of the baby toy; and changing the diaper on the baby while the baby is distracted by the baby toy with the compartment held in the hand of the baby.

2. The method of claim 1 wherein the baby care item is removed from the baby toy before placing the baby toy in the hand of the baby.

3. The method of claim 1 wherein the baby toy with a black, red or white pattern is placed so as to be viewable by the baby.

4. The method of claim 1 wherein the cover is latched before presenting the baby toy to the baby.

* * * * *